US010221846B2

(12) United States Patent
Choi et al.

(10) Patent No.: US 10,221,846 B2
(45) Date of Patent: Mar. 5, 2019

(54) LINEAR COMPRESSOR AND METHOD FOR CONTROLLING A LINEAR COMPRESSOR

(71) Applicant: LG ELECTRONICS INC., Seoul (KR)

(72) Inventors: Jongyoon Choi, Seoul (KR); Donghyun Kim, Seoul (KR); Wooyoung Jung, Seoul (KR); Dowon Kang, Seoul (KR); Hyeongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 177 days.

(21) Appl. No.: 15/335,944

(22) Filed: Oct. 27, 2016

(65) Prior Publication Data

US 2017/0122307 A1 May 4, 2017

(30) Foreign Application Priority Data

Oct. 28, 2015 (KR) ..... 10-2015-0150481

(51) Int. Cl.
*F04B 49/02* (2006.01)
*F04B 35/04* (2006.01)
(Continued)

(52) U.S. Cl.
CPC ..... *F04B 49/022* (2013.01); *F04B 35/04* (2013.01); *F04B 35/045* (2013.01); *F04B 49/06* (2013.01);
(Continued)

(58) Field of Classification Search
CPC ..... F04B 35/045; F04B 39/0005; F04B 2203/0402; F04B 2203/0401;
(Continued)

(56) References Cited

U.S. PATENT DOCUMENTS 5,342,176 A 8/1994 Redlich
6,565,336 B1 5/2003 Fraser
(Continued)

FOREIGN PATENT DOCUMENTS

CN 1443280 9/2003
CN 1480649 3/2004
(Continued)

OTHER PUBLICATIONS

Korean Notice of Allowance dated Oct. 20, 2017.
(Continued)

*Primary Examiner* — Kenneth J Hansen
(74) *Attorney, Agent, or Firm* — KED & Associates LLP

(57) ABSTRACT

A linear compressor is provided which is capable of reducing noise and fabrication costs. The linear compressor may include a piston that performs a reciprocating motion within a cylinder, a linear motor that supplies a driving force to the piston, a sensor that detects a motor voltage and motor current associated with the motor, a valve plate provided at one end of the cylinder to adjust a discharge of a refrigerant compressed in the cylinder, a pressure changing unit or device that changes a variation rate of pressure applied to the piston before the piston reaches the valve plate during the reciprocating motion, and a controller that determines whether the variation rate of the pressure applied to the piston has changed using the detected motor voltage and motor current, and controls the motor to prevent the piston from colliding with the valve plate on the basis of the determination result.

19 Claims, 9 Drawing Sheets

(51) Int. Cl.
*F04B 49/06* (2006.01)
*F04B 49/12* (2006.01)

(52) U.S. Cl.
CPC ..... *F04B 49/065* (2013.01); *F04B 49/12* (2013.01); *F04B 2203/0401* (2013.01); *F04B 2203/0402* (2013.01)

(58) Field of Classification Search
CPC .. F04B 2201/0201; F04B 17/04; F04B 49/10; F04B 49/12; F04B 49/14; F04B 49/103; F04B 49/022; F15B 15/28; F15B 15/2838
USPC ..... 91/1; 92/5 R
See application file for complete search history.

(56) References Cited

U.S. PATENT DOCUMENTS

| | | | | |
|---|---|---|---|---|
| 7,663,275 | B2 | 2/2010 | McGill et al. | |
| 2003/0175135 | A1* | 9/2003 | Heo | F04B 35/045 417/363 |
| 2004/0047751 | A1 | 3/2004 | Kim et al. | |
| 2006/0070518 | A1 | 4/2006 | McGill et al. | |
| 2007/0241697 | A1 | 10/2007 | Sung et al. | |
| 2011/0008191 | A1 | 1/2011 | Lilie et al. | |
| 2011/0318193 | A1 | 12/2011 | Hu | |

FOREIGN PATENT DOCUMENTS

| | | | | |
|---|---|---|---|---|
| CN | 1735749 | | 2/2006 | |
| CN | 1752445 | | 3/2006 | |
| CN | 1755105 | | 4/2006 | |
| CN | 101065578 | | 10/2007 | |
| CN | 101755124 | | 6/2010 | |
| CN | 101835980 | | 9/2010 | |
| CN | 101881264 | | 11/2010 | |
| CN | 102979697 | | 3/2013 | |
| CN | 104728074 | | 6/2015 | |
| EP | 2 365 221 | | 9/2011 | |
| EP | 2 568 173 | | 3/2013 | |
| KR | 2003-0071359 | | 9/2003 | |
| KR | 10-2007-0095518 | | 10/2007 | |
| KR | 10-1451935 | | 10/2014 | |
| KR | 10-1495185 | | 3/2015 | |
| WO | WO 02/095232 | | 11/2002 | |
| WO | WO 2007/123323 | | 11/2007 | |
| WO | WO 2007123323 | A1 * | 11/2007 | F04B 35/045 |
| WO | WO 2009/054654 | | 4/2009 | |

OTHER PUBLICATIONS

European Search Report dated Mar. 10, 2017 issued in Application No. 16195461.5.
Chinese Office Action dated Mar. 13, 2018 issued in Application No. 201611007550.1 (with English Translation).
Chinese Office Action dated Jan. 25, 2018 (English Translation).
European Search Report dated Apr. 3, 2017.
U.S. Appl. No. 15/335,800, filed Oct. 27, 2016, Devon C. Kramer.
U.S. Office Action issued in U.S. Appl. No. 15/335,800 dated Jul. 9, 2018.

* cited by examiner $$Kg \propto \left|\frac{I(jw)}{X(jw)}\right| \cdot Cos(\theta)$$

LINEAR COMPRESSOR AND METHOD FOR CONTROLLING A LINEAR COMPRESSOR

CROSS-REFERENCE TO RELATED APPLICATION(S)

Pursuant to 35 U.S.C. § 119(a), this application claims the benefit of an earlier filing date of and the right of priority to Korean Application No. 10-2015-0150481, filed on Oct. 28, 2015, the contents of which are incorporated by reference herein in its entirety.

BACKGROUND

1. Field

A linear compressor and a method for controlling a linear compressor are disclosed herein.

2. Background

In general, a compressor is an apparatus that converts mechanical energy into compression energy of a compressible fluid, and constitutes a part of a refrigerating device, for example, a refrigerator, or an air conditioner. Compressors are roughly classified into a reciprocating compressor, a rotary compressor, and a scroll compressor. The reciprocating compressor is configured such that a compression space, into and from which an operating gas, such as a refrigerant, is suctioned and discharged, is formed between a piston and a cylinder and the refrigerant is compressed as the linearly reciprocates in the cylinder. The rotary compressor is configured such that a compression space, into and from which an operating gas, such as a refrigerant, is suctioned and discharged, is formed between an eccentrically-rotatable roller and a cylinder and the refrigerant is compressed as the roller eccentrically rotates along an inner wall of the cylinder. The scroll compressor is configured such that a compression space, into and from which an operating gas, such as a refrigerant, is suctioned and discharged, is formed between an orbiting scroll and a fixed scroll and the refrigerant is compressed as the orbiting scroll rotates along the fixed scroll.

The reciprocating compressor sucks, compresses, and discharges a refrigerant by linearly reciprocating the piston within the cylinder. The reciprocating compressor is classified into a recipro type and a linear type according to a method of driving the piston.

The recipro type refers to a type of reciprocating compressor that converts a rotary motion of a motor into a linear reciprocating motion by coupling the motor to a crankshaft and coupling a piston to the crankshaft. On the other hand, the linear type refers to a type of reciprocating compressor that reciprocates a piston using a linear motion of a linearly-moving motor by connecting the piston to a mover of the motor.

The reciprocating compressor includes a motor unit or device that generates a driving force, and a compression unit or device that compresses fluid by receiving the driving force from the motor unit. A motor is generally used as the motor unit, and specifically, the linear type reciprocating compressor uses a linear motor.

The linear motor directly generates a linear driving force, and thus, does not require a mechanical conversion device and a complicated structure. Also, the linear motor may reduce a loss due to energy conversion, and remarkably reduce noise by virtue of the non-existence of a connection portion at which friction and abrasion are caused. Also, when the linear type reciprocating compressor (hereinafter, referred to as a "linear compressor") is applied to a refrigerator or air conditioner, a compression ratio may vary by changing a stroke voltage applied to the linear compressor. Accordingly, the compressor may also be used for a control of varying a freezing capacity.

In the linear compressor, as the piston is reciprocated without being mechanically locked within the cylinder, the piston may collide with (or crash into) a wall of the cylinder when an excessive voltage is applied suddenly, or a compression may not be properly executed when the piston fails to move forward due to a great load. Therefore, a control device for controlling the motion of the piston in response to a variation of the load or voltage is needed.

In general, a compressor control device executes a feedback control by detecting voltage and current applied to a compressor motor and estimating a stroke in a sensor-less manner. In this instance, the compressor control device includes a triac or an inverter that controls the compressor.

The linear compressor performing the feedback control can detect a top dead center (TDC) of the piston only after the piston collides with a discharge valve provided on a discharge unit or device of the cylinder, thereby generating noise due to the collision between the piston and the discharge valve. That is, when the piston collides with the discharge valve in the general linear compressor, a stroke estimation is executed to determine that the piston reaches the TDC of the cylinder. Accordingly, collision noise between the piston and the discharge valve is inevitable.

BRIEF DESCRIPTION OF THE DRAWINGS

Embodiments will be described in detail with reference to the following drawings in which like reference numerals refer to like elements, and wherein.

DETAILED DESCRIPTION

Hereinafter, description will be given in detail of embodiments disclosed herein with reference to the accompanying drawings. It should be noted that technological terms used herein are merely used to describe embodiments, but not to limit the embodiments. Also, unless particularly defined otherwise, technological terms used herein should be construed as a meaning that is generally understood by those having ordinary skill in the art to which the invention pertains, and should not be construed too broadly or too narrowly. Further, if technological terms used herein are wrong terms unable to correctly express the spirit, then they should be replaced by technological terms that are properly understood by those skilled in the art. In addition, general terms used should be construed based on the definition of dictionary, or the context, and should not be construed too broadly or too narrowly.

Hereinafter, one example of a related art type reciprocating compressor will be described with reference to FIG. 1A. As aforementioned, a motor installed in the recipro type reciprocating compressor may be coupled to a crankshaft 1*a*, so as to convert a rotary motion of the motor into a linear reciprocating motion.

Figure 1A:
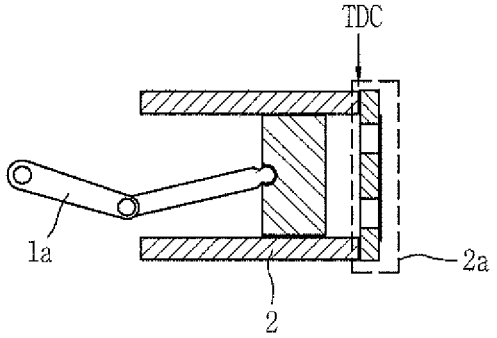
FIG. 1A RELATED ART
FIG. 1A is a conceptual view illustrating one example of a related art recipro type reciprocating compressor.

As illustrated in FIG. 1A, a piston disposed in the recipro type reciprocating compressor may perform a linear reciprocating motion within a preset or predetermined position range according to a specification of the crankshaft or a specification of a connecting rod connecting the piston to the crankshaft. Therefore, for designing the recipro type compressor, when the specifications of the crankshaft and the connecting rod are decided within a range of a TDC, the piston does not collide with a discharge unit or device 2*a* disposed or provided on or at one end of the cylinder 2, even without applying a separate motor control algorithm.

In this instance, the discharge unit 2*a* disposed or provided in the recipro type compressor may be fixed to the cylinder 2. For example, the discharge unit 2*a* may be configured as a valve plate.

However, unlike a linear type compressor to be explained later, the recipro type compressor generates friction among the crankshaft, the connecting rod and the piston, and thus, has more factors generating the friction than the linear type compressor.

Figure 1B:
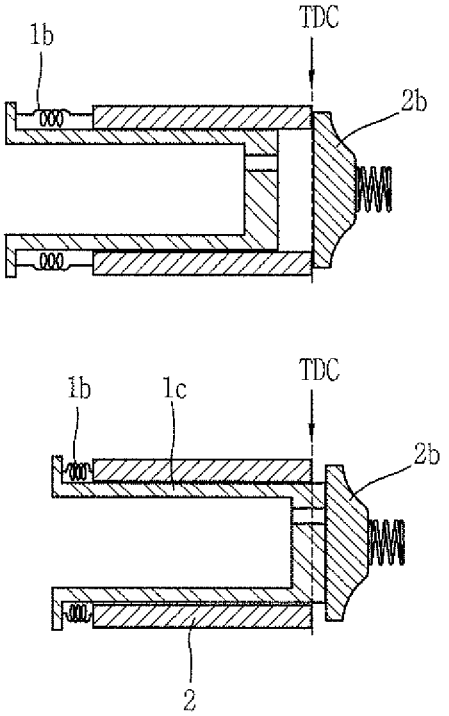
FIG. 1B RELATED ART
FIG. 1B is a conceptual view illustrating one example of a related art linear type reciprocating compressor.
Figure 1C:
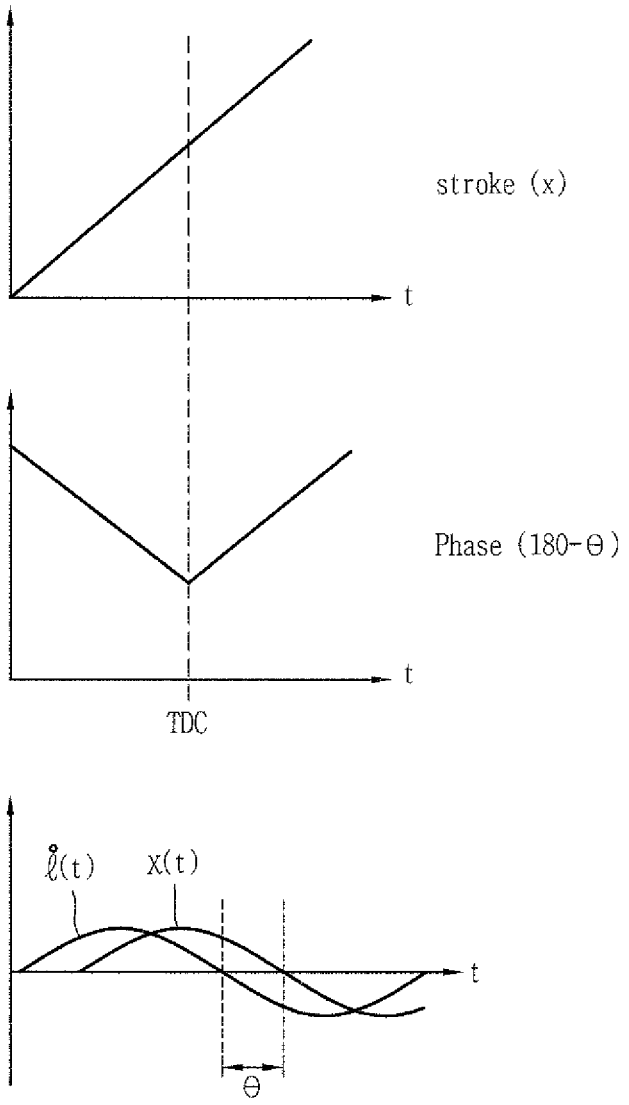
FIG. 1C RELATED ART
FIG. 1C is a graph showing various parameters used in TDC control of the related art linear compressor.

FIG. 1B illustrates one example of a related art linear type reciprocating compressor. FIG. 1C is a graph showing various parameters used in the TDC control of the general linear compressor.

Comparing FIGS. 1A and 1B, unlike the recipro type which implements the linear motion by a motor connected with the crankshaft and the connecting rod, the linear type compressor reciprocates a piston using a linear motion of a linearly-moving motor by connecting the piston to a mover of the motor. As illustrated in FIG. 1B, an elastic member 1*b* may be connected between a cylinder 2 and a piston 1*c* of a linear type compressor. The piston 1*c* may perform a linear reciprocating motor by a linear motor. A controller of the linear compressor may control the linear motor for switching a moving direction of the piston.

The controller of the linear compressor illustrated in FIG. 1B may determine a time point at which the piston collides with a discharge unit or device 2*b* as a time point that the piston reaches the TDC, and accordingly, control the linear motor for converting the moving direction of the piston.

Referring to FIG. 1C together with FIG. 1B, graphs associated with the general linear compressor is shown. As illustrated in FIG. 1C, a phase difference 8 between a motor current i and a stroke x of the piston forms an inflection point at a time point that the piston reaches the TDC.

The controller of the related art linear compressor may detect a motor current i using a current sensor, detect a motor voltage (not illustrated) using a voltage sensor, and estimate a stroke x based on the detected motor current and motor voltage. Accordingly, the controller may calculate the phase difference 8 between the motor current i and the stroke x. When the phase difference 8 generates (forms) an inflection point, the controller may determine that the piston reaches the TDC, and thus, control the linear motor such that a moving direction of the piston is switched. Hereinafter, the operation that the controller of the linear compressor controls the motor such that the piston does not move over the TDC to prevent the collision between the piston and the discharge unit disposed on one end of the cylinder is referred to as "related art TDC control."

When the related art TDC control of the linear compressor illustrated in FIGS. 1B to 1C is executed, the collision between the piston and the discharge unit is inevitable. This collision brings about noise generation.

As illustrated in FIG. 1B, the related art linear compressor executing the related art TDC control may be provided with the discharge unit 2*b* having the elastic member 1*b*. That is, as the related art TDC control inevitably causes the collision between the piston 1*c* and the discharge unit 2*b*, the elastic member 1*b* connected to one portion of the discharge unit 2*b* is provided. The discharge unit 2*b* is heavier and more expensive than the discharge unit 2*a* included in the recipro compressor.

To solve those problems, a compressor according to embodiments disclosed herein may include a discharge unit or device configured as a valve plate. In this instance, for the compressor including the discharge unit configured as the valve plate, the cylinder and the valve plate may be fixedly coupled to each other, and thus, the related art TDC control cannot be applied. That is, in the related art TDC control of the compressor, the collision between the discharge unit and the piston is inevitably caused, like a precondition. Therefore, a TDC control method different from the related TDC control is needed for the compressor according to the embodiments disclosed herein, in which the valve plate is fixed to one end of the cylinder.

The compressor according to embodiments disclosed herein may include a pressure changing unit or device that changes a pressure applied to the piston or a variation rate of the pressure before the piston reaches the valve plate during a reciprocating motion. Also, the controller of the linear compressor may detect a time point at which the pressure applied to the piston or the variation rate of the pressure changes, and control the piston not to collide with the valve plate on the basis of the detected time point.

Specifically, in the related art TDC control, a time point at which a variable associated with the phase difference between the motor current and the stroke of the piston forms the inflection point is detected, and determines whether the piston reaches the TDC. However, it is difficult to detect the change in the pressure applied to the piston or the variation rate of the pressure, which is generated by the pressure changing unit, merely using the variable associated with the phase difference.

Therefore, the controller of the linear compressor according to embodiments disclosed herein may generate a new parameter by applying a motor current and motor voltage detected in real time to a preset or predetermined transformation equation, in order to determine whether the pressure applied to the piston or the variation rate of the pressure has changed by the pressure changing unit.

Hereinafter, embodiments for solving those problems and thusly-obtained effects will be described.

Hereinafter, description will be given with reference to FIG. 2 which illustrates components of a linear compressor according to an embodiment.

Figure 2:
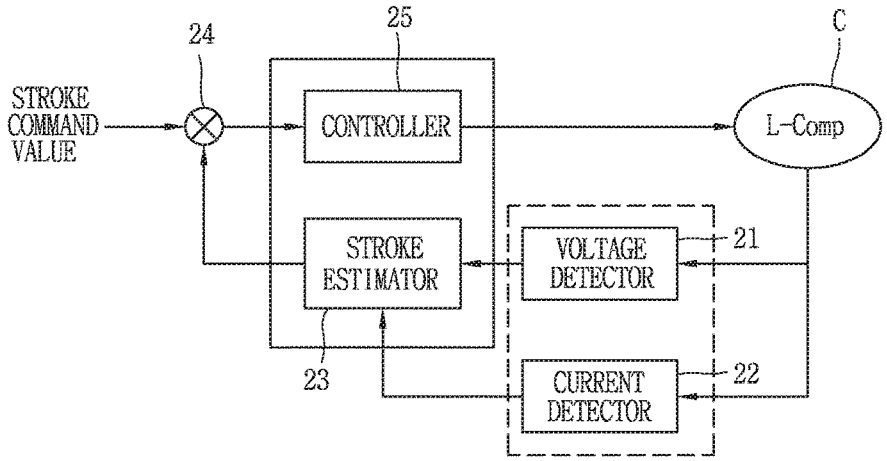
FIG. 2 is a block diagram of a control device for a reciprocating compressor according to an embodiment.

FIG. 2 is a block diagram of a control device for a reciprocating compressor in accordance with an embodiment. As illustrated in FIG. 2, a control device for a reciprocating compressor according to one embodiment may include a sensing unit or sensor that senses (detects) a motor current and a motor voltage associated with a motor.

As illustrated in FIG. 2, the sensing unit may include a voltage detector 21 that detects a motor voltage applied to the motor, and a current detector 22 that detects a motor current applied to the motor. The voltage detector 21 and the current detector 22 may transfer information related to the detected motor voltage and motor current to a controller 25 or a stroke estimator 23.

In addition, referring to FIG. 2, the compressor or the control device for the compressor according to an embodiment may include the stroke estimator 23 that estimates a stroke based on the detected motor current and motor voltage and a motor parameter, a comparer 24 that compares the stroke estimation value with a stroke command value and outputs a difference in the values according to the comparison result, and the controller 25 that controls the stroke by varying the voltage applied to the motor.

These components of the control device illustrated in FIG. 2 are not essential, and greater or fewer components may implement the control device for the compressor. Further, the control device for the compressor according to this embodiment may also be applied to a reciprocating compressor, but this specification will be described based on a linear compressor.

Hereinafter, each component will be described.

The voltage detector 21 may detect the motor voltage applied to the motor. According to one embodiment, the voltage detector 21 may include a rectifying portion and a DC link portion. The rectifying portion may output a DC voltage by rectifying AC power having a predetermined size of voltage, and the DC link portion 12 may include two capacitors.

The current detector 22 may detect the motor current applied to the motor. According to one embodiment, the current detector 22 may detect a current flowing on a coil of the compressor motor.

The stroke estimator 23 may calculate a stroke estimation value using the detected motor current and motor voltage and the motor parameter, and apply the calculated stroke estimation value to the comparer 24. The stroke estimator 23 may calculate the stroke estimation value using the following Equation 1, for example.

$$x(t) = \frac{1}{\alpha}\left[\int\left(V_M - R_{ac}i - L\frac{di}{dt}\right)dt\right] \quad \text{[Equation 1]}$$

Where, x denotes a stroke, α denotes a motor constant or counter electromotive force, $V_M$ denotes a motor voltage, i denotes a motor current, R denotes resistance, and L denotes inductance.

Accordingly, the comparer 24 may compare the stroke estimation value with the stroke command value and apply a difference signal of the values to the controller 25. The controller 25 may thus control the stroke by varying the voltage applied to the motor. That is, the controller 25 may reduce the motor voltage applied to the motor when the stroke estimation value is greater than the stroke command value, while increasing the motor voltage when the stroke estimation value is smaller than the stroke command value.

Figure 4A:
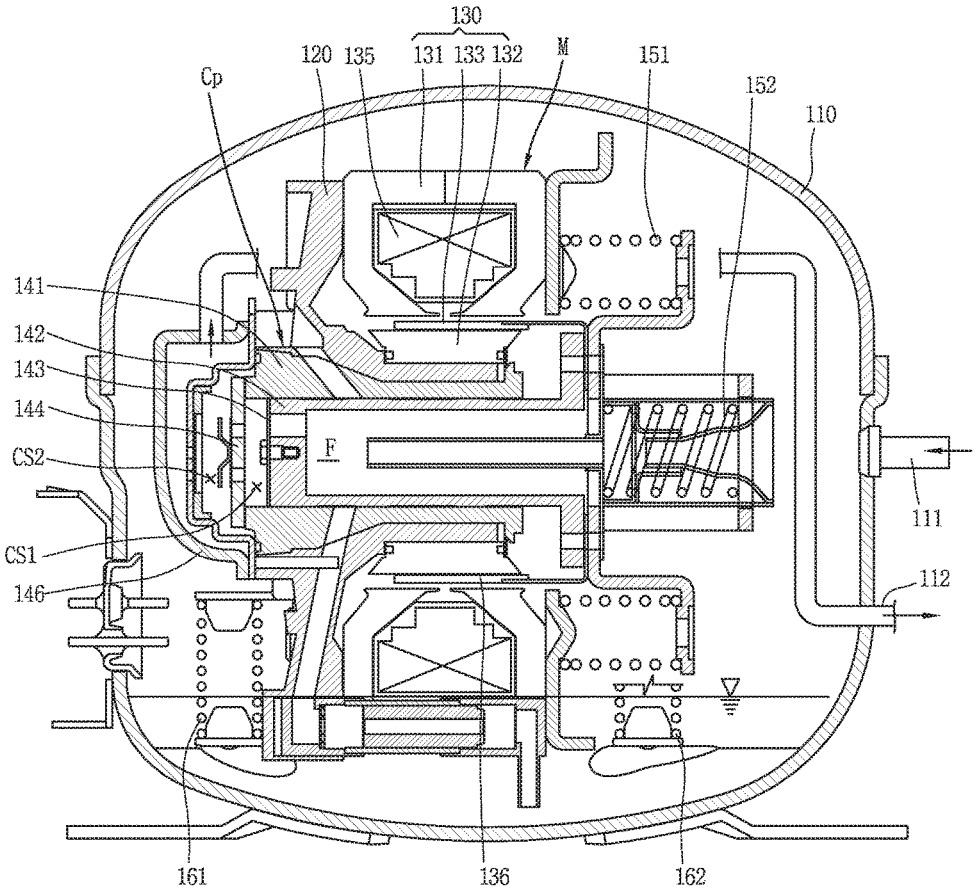
FIG. 4A is a sectional view of the linear compressor according to an embodiment.
Figure 4B:
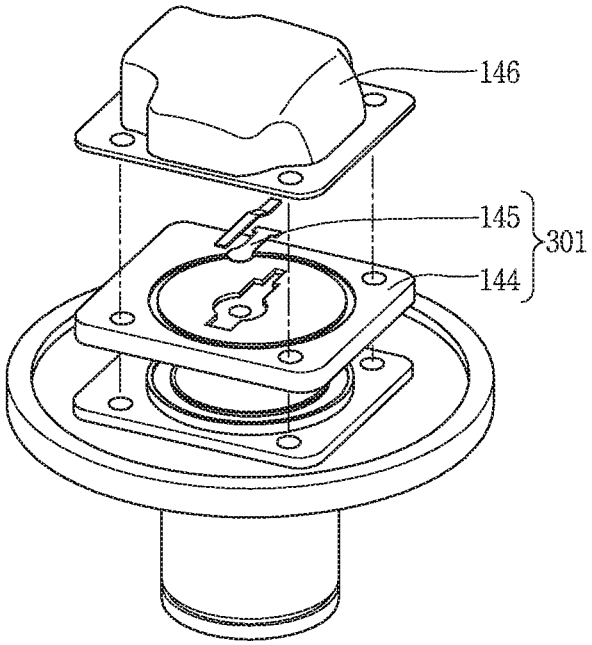
FIG. 4B is a conceptual view illustrating components of a discharge unit or device included in the linear compressor according to an embodiment.

As illustrated in FIG. 2, the controller 25 and the stroke estimator 23 may be configured as a single unit or component. That is, the controller 25 and the stroke estimator 23 may correspond to a single processor or computer. FIGS. 4A and 4B illustrate physical components of the compressor according to an embodiment, as well as the control device for the compressor.

FIG. 4A is a sectional view of the linear compressor according to an embodiment. FIG. 4B is a conceptual view illustrating components of a discharge unit or device included in the linear compressor according to an embodiment.

This embodiment may be applied to any type or shape of linear compressor if the control device for the linear compressor or a compressor control device is applicable thereto. The linear compressor according to the embodiment illustrated in FIG. 4A is merely illustrative, and embodiments are not be limited to this.

In general, a motor applied to a compressor may include a stator with a winding coil and a mover with a magnet. The mover may perform a rotary motion or reciprocating motion according to interaction between the winding coil and the magnet.

The winding coil may be configured in various forms according to a type of motor. For example, the winding coil of a rotary motor may be wound on a plurality of slots, which may be formed on an inner circumferential surface of a stator in a circumferential direction, in a concentrated or distributed manner. For a reciprocating motor, the winding coil may be formed by winding a coil into a ring shape and a plurality of core sheets may be inserted to an outer circumferential surface of the winding coil in a circumferential direction.

Specifically, for the reciprocating motor, the winding coil may be formed by winding the coil into the ring shape. Thus, the winding coil is typically formed by winding a coil on an annular bobbin made of a plastic material.

As illustrated in FIG. 4A, a reciprocating compressor may include a frame 120 disposed or provided in an inner space of a hermetic shell 110 and elastically supported by a plurality of supporting springs 161 and 162. A suction pipe 111, which may be connected to an evaporator (not illustrated) of a refrigerating cycle, may be installed to communicate with the inner space of the shell 110, and a discharge pipe 112, which may be connected to a condenser (not illustrated) of the refrigerating cycle, may be disposed at one side of the suction pipe 111 to communicate with the inner space of the shell 110.

An outer stator 131 and an inner stator 132 of a reciprocating motor 130 which constitutes a motor unit or motor M are fixed to the frame 120, and a mover 133 which performs a reciprocating motion may be interposed between the outer stator 131 and the inner stator 132. A piston 142 constituting a compression unit or device Cp together with a cylinder 141 to be explained later may be coupled to the mover 133 of the reciprocating motor 130.

The cylinder 141 may be disposed or provided in a range overlapping the stators 131 and 132 of the reciprocating motor 130 in an axial direction. A compression space CS1 may be formed in the cylinder 141. A suction passage F, through which a refrigerant may be guided into the compression space CS1, may be formed in the piston 142. A suction valve 143 that opens and closes the suction passage may be disposed or provided on or at an end of the suction passage. A discharge valve 145 that opens and closes the compression space CS1 of the cylinder 141 may be disposed or provided on or at a front surface of the cylinder 141. One example of the cylinder 141 will be described with reference to FIG. 4B.

Figure 3A:
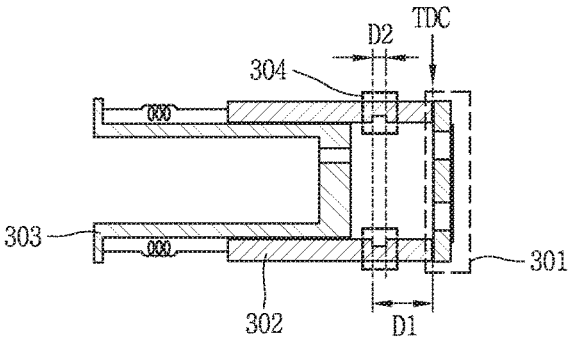
FIGS. 3A to 3C are conceptual views of a linear compressor according to an embodiment.

Referring to FIGS. 3A and 4B, the discharge unit of the linear compressor according to an embodiment may include a valve plate 144, the discharge valve 145 and a discharge cover 146.

The embodiments disclosed herein provides an effect of reducing a weight of the discharge unit by about 5 kg by changing the discharge unit 2*b* (see FIG. 1B) disposed in the related art linear compressor into a valve plate structure. In addition, by reducing the weight of the discharge unit by about 62 times, noise which is generated due to a striking sound of the discharge unit of the linear compressor may be remarkably reduced.

That is, a valve assembly forming the discharge unit may include the valve plate 144 mounted to a head portion of the cylinder 141 (or one end of the cylinder 141), a suction valve disposed or provided in a suction side of the valve plate 144 that opens and closes a suction port, and the discharge valve 145 formed in a cantilever shape and disposed or provided in or at a discharge side of the valve plate 144 that opens and closes a discharge port.

FIG. 4B illustrates an embodiment with one discharge valve 145, but embodiments are not be limited to this. A plurality of the discharge valve 145 may be provided. In addition, the discharge valve 145 may alternatively have a cross shape, other than the cantilever shape.

A plurality of resonant springs 151 and 152 which induce a resonance motion of the piston 142 may be disposed or provided on both sides of the piston 142 in a moving direction thereof, respectively. In the drawing, unexplained reference numeral 135 denotes a winding coil, 136 denotes a magnet, and CS2 denotes a discharge space.

In the related art reciprocating compressor, when power is applied to the coil 135 of the reciprocating motor 130, the mover 133 of the reciprocating motor 130 performs a reciprocating motion. The piston 142 coupled to the mover 133 then performs the reciprocating motion at a fast speed within the cylinder 141. During the reciprocating motion of the piston 142, a refrigerant is introduced into the inner space of the shell 110 through the suction pipe 111. The refrigerant introduced into the inner space of the shell 110 then flows into the compression space CS1 of the cylinder 141 along the suction passage F of the piston 142. When the piston 142 moves forward, the refrigerant is discharged out of the compression space CS1 and then flows toward the condenser of the refrigerating cycle through the discharge pipe 112. This series of processes are repeatedly performed.

The outer stator 131 is formed by radially stacking a plurality of thin half stator cores, each of which may be formed in a shape like ' ' to be symmetrical in a left and right direction, at both left and right sides of the winding coil 135.

Figure 3B:
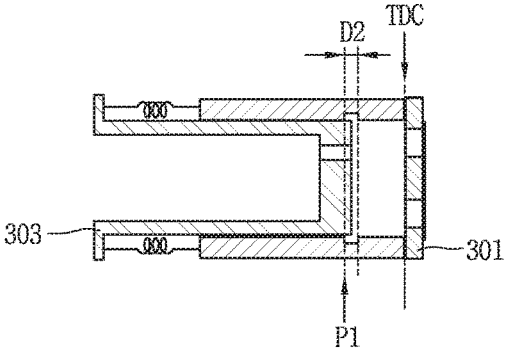
Figure 3C:
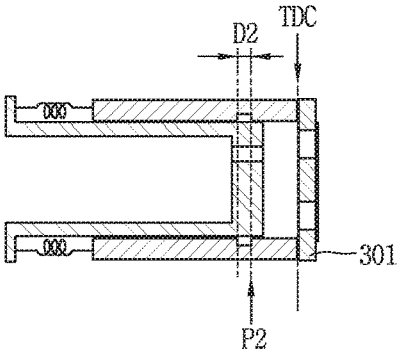

FIGS. 3A to 3C are conceptual views of a linear compressor according to an embodiment. As illustrated in FIG. 3A, a linear compressor according to an embodiment may include a piston 303 that performs a reciprocating motion within a cylinder 302, and a discharge unit or device 301 disposed or provided on or at one end of the cylinder 302 to adjust a discharge of a refrigerant compressed in the cylinder 302.

The discharge unit 301 included in the compressor according to this embodiment may be implemented as a valve plate. The valve plate may be fixed to one end of the cylinder 302. At least one opening through which fluid compressed in the cylinder 302 may flow may be formed through the valve plate.

That is, the discharge unit 301 of the compressor according to this embodiment illustrated in FIG. 3A, unlike the discharge unit 2*b* of the general linear compressor illustrated in FIG. 1B, may be configured as the valve plate. A discharge unit in a shape of a valve plate which is used in the conventional recipro compressor is lighter than the discharge unit illustrated in FIG. 1B and requires less fabricating costs than the discharge unit illustrated in FIG. 1B. The discharge unit of the linear compressor illustrated in FIG. 1B is configured in a PEK valve structure, whereas the discharge unit of the linear compressor according to an embodiment is configured as a valve plate so as to provide an effect of reducing fabricating costs of the compressor. More concretely, the valve plate structure may reduce costs by about 1000 Korean Won per one discharge unit, compared with the PEK valve structure.

In addition, the discharge unit configured as the valve plate is lighter in weight than the discharge unit configured as the PEK valve. Therefore, noise generated due to a striking sound (crashing sound) between the discharge unit and the cylinder when the discharge unit is closed may be reduced. This may result in reducing a thickness of a shell covering the compressor and simplifying a material of a discharge cover. That is, a noise-reducing structure, such as the shell and a muffler, may be simplified in the linear compressor according to embodiments, thereby further reducing fabricating costs in comparison to the related art linear compressor.

Meanwhile, as illustrated in FIG. 3A, the discharge unit of the compressor according to embodiments may be fixed to the one end of the cylinder 302. Accordingly, when executing the related art TDC control illustrated in FIGS. 1B and 1C, stability of the linear compressor is lowered due to the collision between the piston 303 and the discharge unit.

That is, the linear compressor executing the related art TDC control has used the discharge unit having the elastic member. Thus, the linear reciprocating motion of the piston is controlled by determining the collision time point between the discharge unit and the piston as a TDC arrival time point of the piston. However, in the linear compressor according to embodiments, unlike the related art linear compressor, the discharge unit in the shape of the valve plate is fixed to the one end of the cylinder 302. Accordingly, when the related art TDC control is executed, noise may be generated due to the collision between the piston 303 and the discharge unit, operation stability of the compressor may be lowered, and abrasion of the piston 303 and the discharge unit may occur.

Therefore, this specification proposes a method of executing a TDC control, capable of preventing collision between a piston and a discharge unit, in a linear compressor having the discharge unit in a shape of a valve plate. Referring to FIG. 3A, the linear compressor according to embodiments may include a pressure changing unit or device 304 that changes a variation rate of pressure applied to the piston 303 before the piston 303 reaches the valve plate during the reciprocating motion.

As illustrated in FIG. 3A, the pressure changing unit 304 may include a recessed groove provided within the cylinder 302. Also, the pressure changing unit 304 may be disposed or provided at a position spaced apart from one end of the cylinder 302 having the valve plate by a predetermined distance D1.

Although not illustrated in FIG. 3A, the pressure changing unit 304 may include a concave-convex portion formed within the cylinder 302. For example, the concave-convex portion may be connected to the elastic member. When the piston 303 moves over the arranged position of the concave-convex portion, pressure applied to the piston or the variation rate of the pressure may change.

Although not illustrated in FIG. 3A, the pressure changing unit 304 may also include a stepped portion formed on one end of the cylinder. For example, the stepped portion may be formed on an H surface of the cylinder.

The pressure changing unit 304 illustrated in FIG. 3A has the shape of the recessed groove, but the pressure changing unit according to embodiments are not limited to this. The pressure changing unit according to embodiments may be implemented in any type or shape if it can change the pressure applied to the piston 303 or the variation rate of the pressure before the piston 303 reaches the TDC while the piston 303 moves toward the valve plate within the cylinder 302.

That is, the pressure applied to the piston or the variation rate of the pressure before the piston 303 moves over the pressure changing unit is different from the pressure applied to the piston or the variation rate of the pressure until before the piston reaches the TDC after moving over the pressure changing unit. In addition, the pressure changing unit 304 should be designed in a manner that a compression rate of a refrigerant or operation efficiency of the compressor cannot be substantially affected even though the pressure changing unit 304 changes the pressure applied to the piston or the variation rate of the pressure at a specific time point during the reciprocating motion of the piston.

Simultaneously, the pressure or the variation rate of the pressure changed by the pressure changing unit 304 should be high enough to be detected by the controller of the compressor. That is, the controller of the compressor may detect a time point at which the piston passes through the arranged position of the pressure changing unit 304 within the cylinder or a time point at which the pressure changing unit 304 changes the pressure applied to the piston or the pressure variation rate.

Hereinafter, description will be given of one embodiment related to the piston performing a linear reciprocating motion within the cylinder of the compressor according to embodiments, with reference to FIGS. 3B and 3C.

When the piston of the linear compressor according to embodiments moves over a first position P1 where the recessed groove is formed, the controller may determine that the pressure applied to the piston or the pressure variation rate changes. When the piston of the linear compressor moves over a second position P2 where the recessed groove is formed, the controller may determine that the pressure applied to the piston or the pressure variation rate changes. In addition, at a time point at which the piston of the linear compressor moves over the first position P1 and the second position P2 where the recessed groove is formed, the controller may determine that the pressure applied to the piston or the pressure variation rate changes.

In one embodiment, the controller may detect a first time point $T_c$ (see FIGS. 5B and 5C) at which the variation rate of the pressure applied to the piston changes, and control the motor to prevent the piston from reaching the TDC on the basis of the detected first time point $T_c$. Comparing FIGS. 3B, 5B, and 5C, a time point at which the piston reaches the pressure changing unit 304 may correspond to the first time point $T_c$. For example, a time point at which the piston passes through the first position P1 of the recessed groove may correspond to the first time point $T_c$. In another example, a time point at which the piston passes through the second position P2 of the recessed groove may correspond to the first time point $T_c$.

The controller may control the motor to switch a moving direction of the piston at the detected first time point $T_c$, or control the motor to switch the moving direction of the piston after a lapse of a preset or predetermined time interval from the detected first time point $T_c$. The controller may calculate a stroke of the piston in real time and detect the first time point $T_c$ based on the calculated stroke. In this instance, the controller may determine that a second time point (not illustrated) at which a variation rate of the calculated stroke changes more than a preset or predetermined value corresponds to the first time point $T_c$.

Also, the controller may calculate a phase difference between the stroke of the piston and a motor current in real time and detect the first time point $T_c$ based on the calculated phase difference. In this instance, the controller may determine that a second time point (not illustrated) at which a variation rate of the calculated phase difference changes more than a preset or predetermined value corresponds to the first time point $T_c$.

The preset value may change according to an output of the motor. For example, when the output of the motor increases, the controller may reset the preset value to a smaller value.

Although not illustrated, the linear compressor according to embodiments may further include an input unit or input that receives a user input associated with the preset time interval. The controller may reset the time interval based on the user input applied.

The controller may determine whether the piston has moved over the TDC on the basis of information related to the motor current, the motor voltage, and the stroke. In this instance, when it is determined that the piston has moved over the TDC, the controller may change the preset time interval. For example, the controller may reduce the preset time interval when it is determined that the piston has moved over the TDC.

Also, the controller may determine whether the collision between the piston and the valve plate has occurred on the basis of information related to the motor current, the motor voltage, and the stroke. In this instance, the controller may change the preset time interval when it is determined that the collision between the piston and the valve plate has occurred. For example, the controller may reduce the preset time interval when it is determined that the piston has moved over the TDC.

In addition, the linear compressor according to embodiments may include a memory that stores information related to changes in the motor current, the motor voltage, and the stroke during the reciprocating motion of the piston. The memory may store information related to the changes for a time interval within which a reciprocating period of the piston is repeated a predetermined number of times. Accordingly, the controller may determine whether the piston collides with the valve plate using the information related to the change history of the motor voltage, the motor current, and the stroke.

The controller may calculate the stroke of the piston in real time, and detect the first time point $T_c$ based on the calculated stroke. In this instance, the controller may determine that the second time point (not illustrated) at which the variation rate of the calculated stroke changes more than a preset or predetermined value corresponds to the first time point $T_c$.

Also, the controller may calculate the phase difference between the stroke and the motor current in real time and detect the first time point Tc based on the calculated phase difference. In this instance, the controller may determine that the second time point (not illustrated) at which the variation rate of the calculated phase difference changes more than a preset or predetermined value corresponds to the first time point $T_c$.

For example, the controller may detect a time point at which the variation rate of the phase difference is changed from a positive (+) value into a negative (−) value as the first time point $T_c$. As another example, the controller may detect a time point at which the variation rate of the phase difference is changed from a negative (−) value into a positive (+) value as the first time point $T_c$.

Figure 5A:
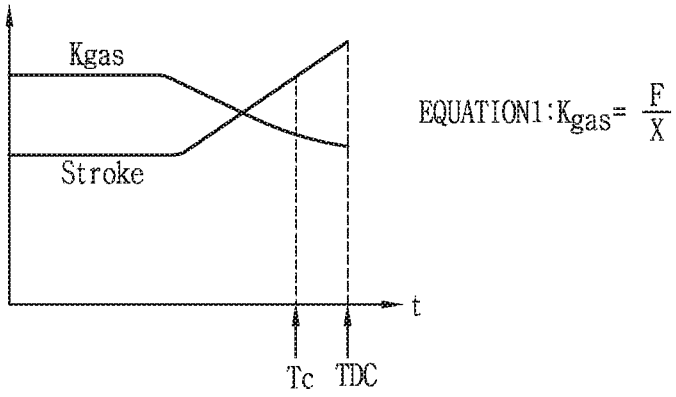
FIGS. 5A to 5C are graphs showing various parameters used for controlling the linear compressor according to an embodiment.
Figure 5B:
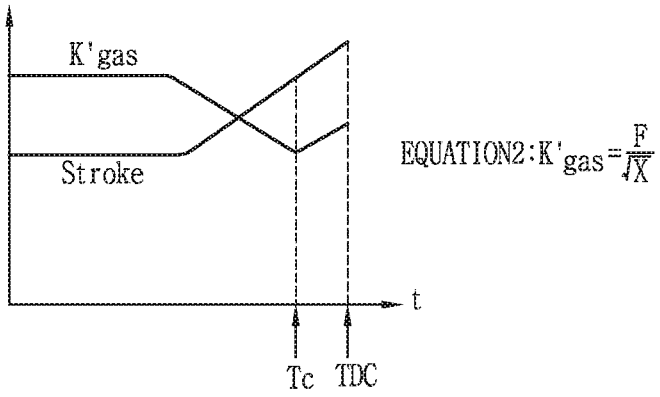
Figure 5C:
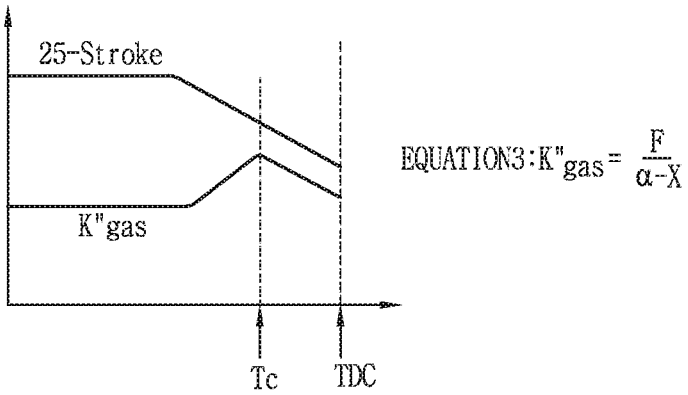

FIGS. 5A to 5C are graphs showing changes in parameters for executing the TDC control of the piston according to one example of the linear reciprocating motion of the piston illustrated in FIGS. 3B and 3C. As illustrated in FIG. 5A, the controller of the linear compressor according embodiments may calculate in real time a first gas constant $K_g$ associated with the reciprocating motion of the piston, using detected motor current and motor voltage and an estimated stroke.

The controller may calculate the first gas constant $K_g$ using the following Equation 2.

$$k_g = \alpha \times \left| \frac{I(jw)}{X(jw)} \right| \times \cos(\theta_{i,x}) + mw^2 - k_m \quad \text{[Equation 2]}$$

Where, I(jw) denotes a peak value of a current for one cycle, X(jw) denotes a peak value of a stroke for one cycle, a denotes a motor constant or counter electromotive force, θi,x denotes a phase difference between a current and a stroke, m denotes a moving mass of the piston, w denotes an operating frequency of a motor, $K_m$ denotes a mechanical spring constant.

Also, Equation 3 related to the first gas constant $K_g$ is derived by the above equation.

$$k_g \propto \left| \frac{I(jw)}{X(jw)} \right| \times \cos(\theta_{i,x}) \quad \text{[Equation 3]}$$

That is, the calculated first gas constant $K_g$ may be in proportion to the phase difference between the motor current and the stroke.

Therefore, the controller may detect based on the calculated first gas constant $K_g$ the time point at which the pressure applied to the piston or the variation rate of the pressure changes. That is, the controller may detect the first gas constant $K_g$ in real time and detect the first time point $T_c$ based on the calculated first gas constant $K_g$. In this instance, the controller may determine that a second time point (not illustrated) at which a variation rate of the calculated first gas constant $K_g$ changes more than a preset or predetermined value corresponds to the first time point $T_c$.

Referring to FIG. 5A, however, it is difficult to detect the time point Tc at which the pressure applied to the piston or the pressure variation rate is changed by the pressure changing unit, merely based on the changes in the first gas constant $K_g$. That is, in the related art TDC control, the controller of the linear compressor determines formation or non-formation of the inflection point of the first gas constant $K_g$ and uses the determination result as a basis of determining whether the piston reaches the TDC. However, as illustrated in FIG. 5A, the variation of the first gas constant $K_g$ may not be great enough to be detected by the controller before and after the time point $T_c$ at which the pressure or the pressure variation rate changes.

Therefore, as illustrated in FIGS. 5B and 5C, the controller of the linear compressor according to embodiments may calculate a parameter associated with the movement of the piston using the estimated stroke and the detected motor current. In addition, the controller may control the motor based on a time point that the calculated parameter forms an inflection point.

According to this control method, the TDC control for preventing the collision between the piston and the discharge unit of the linear compressor may be effectively executed even without using a separate sensor.

The linear compressor or its control device according to embodiment may include a memory that stores information related to at least one transformation equation for calculating a parameter. In addition, the controller may calculate the parameter associated with the movement of the piston in real time using the information related to the transformation equation stored in the memory and an estimated stroke value. For example, the parameter calculated by the transformation equation may form an inflection point at a time point at which the variation rate of the pressure applied to the piston changes before the piston reaches the TDC.

As illustrated in FIG. 5B, one example of the transformation equation stored in the memory may be $Y=\sqrt{X}$. Y may denote a calculated parameter, and X may denote an estimated stroke. The controller may calculate using the equation a second gas constant $K'_g$ forming an inflection point at a time point at which the pressure applied to the piston or the variation rate of the pressure changes.

Another example of the stored transformation equation may be $Y=\alpha-X$. Y may denote a calculated parameter, X may denote an estimated stroke, and a may denote a preset or predetermined constant. A number 25 may be substituted for one example of α. The controller may calculate using the equation a third gas constant $K''_g$ forming an inflection point at the time point at which the pressure applied to the piston or the variation rate of the pressure changes.

Therefore, the controller may detect the time point at which the pressure applied to the piston or the pressure variation rate changes on the basis of at least one of the calculated second gas constant $K'_g$ and third gas constant $K''_g$. That is, the controller may calculate the second gas constant $K'_g$ or the third gas constant $K''_g$, and detect the first time point $T_c$ based on the calculated second or third gas constant $K'_g$ or $K''_g$. In this instance, the controller may determine that a second time point (not illustrated) at which a variation rate of the second or third gas constant changes more than a preset or predetermined value corresponds to the first time point $T_c$. For example, the first time point $T_c$ may correspond to the time point at which the second or third gas constant $K'_g$ or $K''_g$ forms the inflection point.

Also, the controller may compare a plurality of control variables transformed by a plurality of transformation equations when information related to the plurality of transformation equations is stored in the memory, and drive the motor based on the comparison result. For example, the controller may drive the motor to switch the moving direction of the piston when at least one of the plurality of control variables transformed by the plurality of transformation equations forms the inflection point. In addition, the controller may detect the first time point Tc at which the inflection point of the calculated parameter is formed, and control the motor to prevent the piston from colliding with the valve plate based on the detected first time point Tc.

The controller may control the motor to switch the moving direction of the piston after a lapse of a preset or predetermined time interval from the detected first time point Tc. The preset time interval may be changed by the user. Also, the controller may detect the variation rate of the calculated parameter in real time, and determine that a second time point (not illustrated) at which the detected variation rate changes more than a preset or predetermined value corresponds to the first time point Tc that the inflection point is formed.

Figure 6:
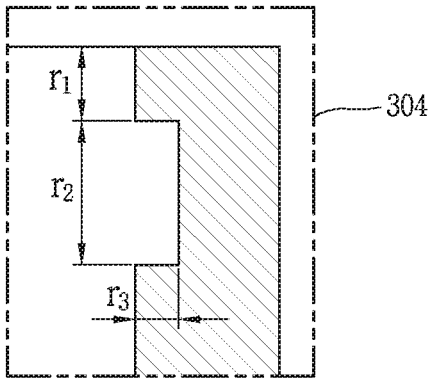
FIG. 6 is a conceptual view illustrating one example of a pressure changing unit or device of the linear compressor according to an embodiment.

Hereinafter, one embodiment of the pressure changing unit 304 of the linear compressor according to embodiments will be described with reference to FIG. 6. The pressure changing unit 304 may be provided between the TDC and a bottom dead center (BDC) of the cylinder.

The pressure changing unit 304 may include a recessed groove formed within the cylinder 302. As illustrated in FIG. 6, one end of the recessed groove may be located at a position spaced apart from one end of the cylinder or the TDC of the cylinder by a first distance $r_1$. A width of the recessed groove may be a second distance $r_2$. A depth of the recessed groove may be a third distance $r_3$.

For example, the first distance may be included in a range of about 1.5 mm to about 3 mm. In another example, the third distance may be included in a range of about 2 mm to about 4 mm. In another example, the second distance may be included in a range of about 0.3 mm to about 0.4 mm.

The memory may include information related to the groove. In this instance, the controller may detect the first time point Tc, and control the motor to prevent the piston from reaching the TDC based on the stored information related to the recessed groove. For example, the recessed groove-related information may include at least one of information related to the width of the recessed groove, information related to the depth of the recessed groove, and information related to a distance between the one end of the recessed groove and the TDC.

Figure 7:
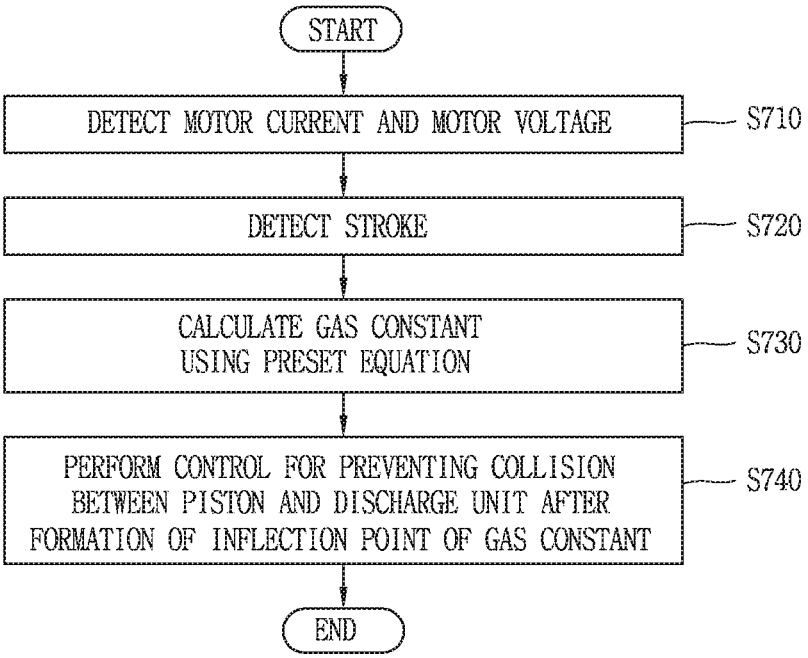
FIG. 7 is a flowchart of a method for controlling a linear compressor according to an embodiment.

Hereinafter, a method for controlling a linear compressor according to an embodiment will be described with reference to FIG. 7.

The voltage detector 21 may detect a motor voltage and the current detector 22 may detect a motor current (S710). The voltage detector 21 and the current detector 22 may detect the motor voltage and the motor current, respectively, while the piston performs the linear reciprocating motion. Next, the stroke estimator 23 may detect a stroke of the piston using at least one of the detected motor voltage or the detected motor current (S720).

The pressure changing unit of the linear compressor according to an embodiment may change the pressure applied to the piston or the variation rate of the pressure before the piston reaches the TDC within the cylinder. Next, the controller 25 may calculate a gas constant using the detected motor voltage, motor current, and stroke, and a preset or predetermined transformation equation (S730). The controller 25 may calculate a phase difference between the detected motor voltage and the stroke.

The controller 25 may control the motor to prevent collision between the piston and the discharge unit after an inflection point of the gas constant is formed (S740). In addition, the controller 25 may control the motor to prevent the collision between the piston and the discharge unit after an inflection point of the calculated phase difference is formed. That is, the controller 25 may control the motor to switch the moving direction of the piston at a time point at which a preset or predetermined time interval elapses after the inflection point of the gas constant or the phase difference is formed.

In a linear compressor and a method for controlling the same according to embodiments, collision between a piston and a discharge valve may be prevented so as to reduce noise generated in the linear compressor. Also, the prevention of the collision between the piston and the discharge valve may result in a reduction in abrasion of the piston and the discharge valve caused due to the collision, thereby extending a lifespan of mechanisms and components of the linear compressor.

In a linear compressor and a method for controlling a linear compressor according to embodiments, fabricating costs of the discharge valve may be reduced, and fabricating costs of the linear compressor may be reduced accordingly. Noise reduction and high-efficiency operation may simultaneously be obtained even without the addition of a separate sensor.

Embodiments disclosed herein provide a linear compressor capable of reducing noise by preventing collision between a piston and a discharge valve even without employing a separate sensor, and a method for controlling a linear compressor. Embodiments disclosed herein further provide a linear compressor capable of executing a high efficiency operation while reducing noise, and a method for controlling a linear compressor. Embodiments disclosed herein also provide a linear compressor capable of reducing noise generation and fabricating costs.

To achieve these and other advantages and in accordance with the purpose of this specification, as embodied and broadly described herein, there is provided a linear compressor that may include a piston to perform a reciprocating motion within a cylinder, a linear motor to supply a driving force for the motion of the piston, a sensing unit or sensor to detect a motor voltage and a motor current associated with the motor, a valve plate provided on or at one end of the cylinder to adjust a discharge of a refrigerant compressed in the cylinder, a pressure changing unit or device to change a variation rate of pressure applied to the piston before the piston reaches the valve plate during the reciprocating motion, and a controller to determine whether or not the variation rate of the pressure applied to the piston has changed using the detected motor voltage and motor current, and control the motor to prevent the piston from colliding with the valve plate on the basis of the determination result. In one embodiment disclosed herein, the linear compressor may include a stroke estimator to estimate a stroke of the piston using the detected motor voltage and motor current, and the controller may control the motor based on a phase difference between the estimated stroke and the motor current. In one embodiment disclosed herein, the controller may calculate a parameter associated with a movement of the piston in real time using the estimated stroke and the detected motor current, and control the motor based on a time point that the calculated parameter forms an inflection point.

In one embodiment disclosed herein, the linear compressor may further include a memory to store information related to at least one transformation equation for calculating the parameter, and the controller may calculate the parameter in real time using the stored information related to the transformation equation and the estimated stroke. In one embodiment disclosed herein, the parameter calculated by the transformation equation may form the inflection point at a time point that the variation rate of the pressure applied to the piston changes before the piston reaches a top dead center (TDC).

In one embodiment disclosed herein, when information related to a plurality of transformation equations is stored in the memory, the controller may compare a plurality of control variables transformed by the plurality of transformation equations, and drive the motor based on the comparison result. In one embodiment disclosed herein, the controller may drive the motor to switch a moving direction of the piston when at least one of the plurality of control variables transformed by the plurality of transformation equations forms an inflection point.

In one embodiment disclosed herein, the controller may detect a first time point that the inflection point of the calculated parameter is formed, and control the motor to prevent the piston from colliding with the valve plate on the basis of the detected first time point. In one embodiment disclosed herein, the controller may control the motor to switch a moving direction of the piston after a lapse of a preset or predetermined time interval from the detected first time point. In one embodiment disclosed herein, the controller may detect a variation rate of the calculated parameter in real time, and determine that a second time point that the detected variation rate changes more than a preset or predetermined value corresponds to the first time point that the inflection point is formed.

In one embodiment disclosed herein, the stored transformation equation may be $Y=\sqrt{X}$, where Y may denote the calculated parameter and X may denote the estimated stroke. In one embodiment disclosed herein, the stored transformation equation may be $Y=\alpha-X$, where Y may denote the calculated parameter, X may denote the estimated stroke and $\alpha$ may denote a preset constant.

In one embodiment disclosed herein, the pressure changing unit may include a recessed groove formed within the cylinder. In one embodiment disclosed herein, the valve plate may be fixed to one end of the cylinder.

To achieve these and other advantages and in accordance with the purpose of this specification, as embodied and broadly described herein, there is provided a method for controlling a linear compressor, in a compressor including a piston to perform a reciprocating motion within a cylinder, a linear motor to supply a driving force for the motion of the piston, and a valve plate provided on or at one end of the cylinder to adjust a discharge of a refrigerant compressed in the cylinder. The method may include detecting a motor current and a motor voltage of the compressor while the piston performs a linear reciprocating motion, determining whether or not a variation rate of pressure applied to the piston has changed using the detected motor voltage and motor current, and controlling the motor to prevent the piston from colliding with the valve plate on the basis of the determination result.

In one embodiment disclosed herein, the method may further include calculating a parameter associated with a movement of the piston in real time by using an estimated stroke of the piston and the detected motor current. The controlling the motor may include switching a moving direction of the piston before the piston collides with the valve plate, on the basis of a time point that the calculated parameter forms an inflection point.

In one embodiment disclosed herein, the compressor may further include a memory to store information related to at least one transformation equation for calculating the parameter, and the calculating the parameter may include calculating the parameter in real time using the stored information related to the transformation equation and the estimated stroke. In one embodiment disclosed herein, the parameter calculated by the transformation equation may form the inflection point at a time point that the variation rate of the pressure applied to the piston changes before the piston reaches a top dead center (TDC).

In one embodiment disclosed herein, the method may further include comparing a plurality of control variables transformed by a plurality of transformation equations when information related to the plurality of transformation equations is stored in the memory, and driving the motor based on the comparison result. In one embodiment disclosed herein, the method may further include detecting a time point that the inflection point of the calculated parameter is formed, and switching the moving direction of the piston after a lapse of a preset or predetermined time interval from the detected time point.

Further scope of applicability will become more apparent from the detailed description given hereinafter. However, it should be understood that the detailed description and specific examples, while indicating embodiments, are given by way of illustration only, since various changes and modifications within the spirit and scope will become apparent to those skilled in the art from the detailed description.

It will be apparent to those skilled in the art that various modifications and variations can be made without departing from the spirit or scope. Thus, it is intended that embodiments cover modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a piston that performs a reciprocating motion within a cylinder;

a linear motor that supplies a driving force to the piston;

a sensor that detects a motor voltage and a motor current associated with the motor;

a valve plate provided at one end of the cylinder to adjust a discharge of a refrigerant compressed in the cylinder;

a pressure changing unit that changes a variation rate of pressure applied to the piston before the piston reaches the valve plate during the reciprocating motion; and a controller that determines whether the variation rate of the pressure applied to the piston has changed using the detected motor voltage and motor current, and controls the motor to prevent the piston from colliding with the valve plate on a basis of the controller determining whether the variation rate of the pressure applied to the piston has changed, wherein the controller calculates a parameter associated with a movement of the piston in real time using the detected motor voltage and the detected motor current, and detects a time point at which the calculated parameter forms an inflection point, and wherein the controller controls the motor to switch a moving direction of the piston after a lapse of a predetermined time interval from the detected time point.

2. The linear compressor of claim 1, further including a stroke estimator that estimates a stroke of the piston using the detected motor voltage and motor current, wherein the controller controls the motor based on a phase difference between the estimated stroke and the motor current.

3. The linear compressor of claim 2, wherein the controller calculates the parameter using the estimated stroke and the detected motor current.

4. The linear compressor of claim 3, further including a memory that stores information related to at least one transformation equation for calculating the parameter, wherein the controller calculates the parameter in real time using the stored information related to the transformation equation and the estimated stroke.

5. The linear compressor of claim 4, wherein the parameter calculated by the transformation equation forms the inflection point at a time point at which the variation rate of the pressure applied to the piston changes before the piston reaches a top dead center (TDC) position.

6. The linear compressor of claim 4, wherein the controller, when information related to a plurality of transformation equations is stored in the memory, compares a plurality of control variables transformed by the plurality of transformation equations, and drives the motor based on a result of comparing the plurality of control variables by the plurality of transformation equations.

7. The linear compressor of claim 6, wherein the controller drives the motor to switch a moving direction of the piston when at least one of the plurality of control variables transformed by the plurality of transformation equations forms an inflection point.

8. The linear compressor of claim 4, wherein the stored transformation equation $Y=F/\sqrt{X}$, where Y denotes the calculated parameter F denotes the pressure applied to the piston, and X denotes the estimated stroke.

9. The linear compressor of claim 4, wherein the stored transformation equation is $Y=F/(\alpha-X)$, where Y denotes the calculated parameter, F denotes the pressure applied to the piston, X denotes the estimated stroke, and cc denotes a predetermined constant.

10. The linear compressor of claim 3, wherein the controller detects a first time point at which the inflection point of the calculated parameter is formed, and controls the motor to prevent the piston from colliding with the valve plate on the basis of the detected first time point.

11. The linear compressor of claim 10, wherein the controller detects a variation rate of the calculated parameter in real time, and determines that a second time point at which the detected variation rate changes more than a predetermined value corresponds to the first time point at which the inflection point is formed.

12. The linear compressor of claim 1, wherein the pressure changing unit includes a recessed groove formed within the cylinder.

13. The linear compressor of claim 1, wherein the valve plate is fixed to the one end of the cylinder.

14. A method for controlling a linear compressor, in a compressor including a piston that performs a reciprocating motion within a cylinder, a linear motor that supplies a driving force to the piston, and a valve plate provided at one end of the cylinder to adjust a discharge of a refrigerant compressed in the cylinder, the method comprising:

detecting a motor current and a motor voltage of the compressor while the piston performs a linear reciprocating motion;

determining whether a variation rate of pressure applied to the piston has changed using the detected motor voltage and motor current;

controlling the motor to prevent the piston from colliding with the valve plate on a basis of the determining whether the variation rate of the pressure applied to the piston has chanced;

calculating a parameter associated with a movement of the piston in real time using an estimated stroke of the piston and the detected motor current, wherein the controlling the motor includes switching a moving direction of the piston before the piston collides with the valve plate, on the basis of a time point at which the calculated parameter forms an inflection point;

detecting a time point at which the inflection point of the calculated parameter is formed; and switching the moving direction of the piston after a lapse of a predetermined time interval from the detected time point.

15. The method of claim 14, wherein the compressor further includes a memory to store information related to at least one transformation equation for calculating the parameter, and wherein the calculating the parameter includes calculating the parameter in real time using the stored information related to the transformation equation and the estimated stroke.

16. The method of claim 15, wherein the parameter calculated by the transformation equation forms the inflection point at a time point at which the variation rate of the pressure applied to the piston changes before the piston reaches a top dead center (TDC) position.

17. The method of claim 15, further including:

comparing a plurality of control variables transformed by a plurality of transformation equations when information related to the plurality of transformation equations is stored in the memory; and driving the motor based on a result of the comparing the plurality of control variables by the plurality of transformation equations.

18. A linear compressor, comprising:

a piston that performs a reciprocating motion within a cylinder;

a linear motor that supplies a driving force to the piston;

a sensor that detects a motor voltage and a motor current associated with the motor;

a valve plate provided at one end of the cylinder to adjust a discharge of a refrigerant compressed in the cylinder;

a recessed groove formed in the cylinder, wherein the recessed groove changes a variation rate of pressure applied to the piston before the piston reaches the valve plate during the reciprocating motion; and a controller that determines whether the variation rate of the pressure applied to the piston has changed using the detected motor voltage and motor current, and controls the motor to prevent the piston from colliding with the valve plate on a basis of the controller determining whether the variation rate of the pressure applied to the piston has changed, wherein a distance of the groove from the one end of the cylinder is a first distance, a width of the recessed groove is a second distance, and a depth of the groove is a third distance, and wherein the first distance is in a range of about 1.5 mm to about 3 mm, the second distance is in a range of about 2 mm to about 4 mm, and the third distance is in a range of about 0.3 mm to 0.4 mm.

19. The linear compressor of claim 18, wherein the recessed groove is spaced a predetermined distance from the one end of the cylinder.

* * * * *